United States Patent [19]

Hayashi et al.

[11] Patent Number: 5,047,383

[45] Date of Patent: Sep. 10, 1991

[54] HEAT-SENSITIVE RECORDING MATERIAL WITH A SUBSTRATE COMPRISING A FOAMED POLYESTER RESIN FILM CONTAINING MINUTE CAVITIES

[75] Inventors: Hiroo Hayashi; Katsuhiko Ishida, both of Takatsuki; Toshimitsu Arikawa, Ibaraki, all of Japan

[73] Assignee: Kanzaki Paper Manufacturing Co., Ltd., Tokyo, Japan

[21] Appl. No.: 496,203

[22] Filed: Mar. 19, 1990

[30] Foreign Application Priority Data

Mar. 17, 1989 [JP] Japan ..... 1-66683

[51] Int. Cl.[5] ..... B41M 5/40

[52] U.S. Cl. ..... 503/200; 427/152; 503/226

[58] Field of Search ..... 427/152; 503/200, 226

[56] References Cited

U.S. PATENT DOCUMENTS 4,980,337 12/1990 Kawasaki et al. ..... 503/226

*Primary Examiner*—Pamela R. Schwartz

*Attorney, Agent, or Firm*—Wenderoth, Lind & Ponack

[57] ABSTRACT

An improved heat-sensitive recording material of the type having a substrate and a heat-sensitive recording layer formed on said substrate, said heat-sensitive recording layer containing a color former and a color developer to color said color former upon contact by heating, characterized in that said substrate comprises an adiabatic foamed polyester resin film containing minutes cavities with an apparent specific gravity in the range of 0.9 to 1.2.

4 Claims, No Drawings

HEAT-SENSITIVE RECORDING MATERIAL WITH A SUBSTRATE COMPRISING A FOAMED POLYESTER RESIN FILM CONTAINING MINUTE CAVITIES

FIELD OF THE INVENTION

The present invention relates to an improved heat-sensitive recording material which excels in sensitivity and thermal characteristics and provides high quality images excelling in gradation and resolution. More particularly, the present invention relates to an improved heat-sensitive recording material having a substrate comprising a foamed polyester resin film containing minute cavities with an apparent specific gravity in the range of 0.9 to 1.2 which excels in sensitivity and thermal characteristics and provides high quality images without the heat-sensitive recording material being deformed by heat.

BACKGROUND OF THE INVENTION

There are known a number of heat-sensitive recording materials of the type that is so designed as to produce a record image when a color former and a color developer are brought into contact with each other by heat. Those heat-sensitive recording materials of this type are comparatively inexpensive and suitable for use on a compact recording machine, which is relatively easy in its maintenance. In fact, they are used as a recording medium in facsimile system, various computer systems, medical instruments, heat-sensitive copying systems, and printers of other various instruments.

In recent years, various information instruments have been developed and they have been used in various sectors. Along with this situation, various demands have been made for the heat-sensitive recording material to be used as a recording medium in those information instruments.

For instance, as for the facsimile system, there have been commercialized various minimized facsimile systems of improved high recording speed. In this respect, there is an increased demand for providing an improved heat-sensitive recording material which capable of instantly and precisely responding to a slight printing energy to record high quality clear images excelling in gradation and resolution corresponding to information signals transmitted. Other than this, in recent years, various video-printers capable of providing high quality photograph-like images have been commercialized. For the heat-sensitive recording material to be used for recording information outputted from those printers, it is demanded to be such that can provide a sufficient recording density (optical density) in the entire density range from low density region to high density region, satisfactory gradation and resolution (reproduction of dots) for images obtained. Further, various bar code printers of handy type have been commercialized in recent years. For the heat-sensitive recording material to be used in those printers, there is also the same increased demand as in the case of the foregoing facsimile system.

To meet the above demands, there have been made developed relevant color formers, color developers and sensitizers. There have been made proposals also on the substrate on which a heat-sensitive recording layer is to be disposed. That is, as the substrate, use of a synthetic sheet such as foamed polyolefin film or an opaque synthetic resin film such as polyolefin resin film containing a pigment has been proposed aiming at improving the resolution of an image to be provided. However, for the heat-sensitive recording material having the substrate comprising a foamed polyolefin film, although it is satisfactory in its recording sensitivity and there can be obtained images satisfactory in resolution, there is a problem that the substrate is not sufficient in its heat resistance and because of this, the portions of the heat-sensitive recording material on which images are to be recorded are likely to deform due to heat at the time of recording by a thermal head and to cause local extension or curling on the heat-sensitive recording material.

Especially, when the foregoing heat-sensitive recording material is used in the foregoing videoprinter or bar code printer, since images having solid parts (whole black parts) in greater numbers in comparison with the images of character informations are recorded thereon, the above problems are often caused to make the resultant recorded product accompanied with deformed portions due to local extensions and/or curlings.

In this consequence, there is an increased demand for providing a desirable heat-sensitive recording material which is free of the foregoing problems found on the known heat-sensitive recording material and which provides a desirable image-recorded product in any of the recording systems.

SUMMARY OF THE INVENTION

The main object of the present invention is to eliminate the foregoing problems found on the known heat-sensitive recording material and to provide an improved heat-sensitive recording material which is free of those problems.

Another object of the present invention is to provide an improved heat-sensitive recording material which excels not only in sensitivity but also in heat resistance, and is capable of providing high quality images excelling in gradation and resolution (reproduction of dots).

A further object of the present invention is to provide an improved heat-sensitive recording material which is highly heat-resistant and is not deformed upon printing with a high heat energy by a thermal head, and which provides high quality images.

The present inventors have made extensive studies in order to solve the foregoing problems which are found on the known heat-sensitive recording material and in order to attain the above objects while focusing on the substrate on which a heat-sensitive recording layer is to be disposed.

As a result, it was found that when a specific foamed polyester resin film containing minute cavities with an apparent specific gravity in the range of 0.9 to 1.2 is used as the substrate on which a heat sensitive recording layer is to be disposed, there is afforded a desirable heat-sensitive recording material which excels in both heat sensitivity and heat resistance, is not deformed upon printing with a high heat energy by a thermal head and provides high quality images excelling in gradation and resolution (reproduction of dots).

The present invention has been accomplished based on the above finding.

The present invention resides in an improved heat-sensitive recording material comprising a substrate and a heat-sensitive recording layer formed thereon which contains a color former and a color developer capable of coloring said color former upon contact by heating, characterized in that the substrate is comprised of an adiabatic foamed polyester resin film containing minute cavities with an apparent specific gravity in the range of 0.9 to 1.2.

The heat-sensitive recording material according to the present invention has a desirable cushioning property and is not deformed upon printing with a high heat energy. And the heat-sensitive recording material is that quickly responds to a heat energy applied based on a signal of information transmitted in facsimile system, computer system or like other systems and provides high quality images excelling in gradation and resolution (reproduction of dots).

DETAILED DESCRIPTION OF THE INVENTION

As described above, the heat-sensitive recording material comprises a substrate and a heat-sensitive recording layer formed thereon, said substrate comprising a specific adiabatic foamed polyester resin film containing minute cavities with an apparent specific gravity in the range of 0.9 to 1.2 (hereinafter referred simply to as "adiabatic foamed polyester resin film"), and said heat-sensitive recording layer containing a color former i.e. colorless or light-colored basic dye and a color developer capable of coloring said color former upon contact by heating.

The heat-sensitive recording material according to the present invention is characterized by having a substrate comprising the foregoing specific foamed polyester resin film which has an excellent adiabatic property and exhibits an excellent cushioning property.

Because of this, the heat-sensitive recording material according to the present invention quickly and precisely responds to a heat energy corresponding to an information signal transmitted in the printing mechanism of facsimile system, computer system and provides highly clear images having a sufficient optical density throughout the entire region from low optical density region to high optical density region and which excel in gradation and resolution, without causing local extension or curling for the heat-sensitive recording material.

The foregoing adiabatic foamed polyester resin film to be used as the substrate of the heat-sensitive recording material according to the present invention can be properly prepared in accordance with the known method of preparing a foamed resin film. For instance, it can be prepared by providing a polyester resin and a substance which is not mutual soluble with said resin (this substance will be hereinafter referred to as "non-compatible substance"); mixing said resin and the non-compatible substance to obtain a mixture; subjecting the mixture to melt-extrusion to obtain a non-oriented film; and subjecting the resultant non-oriented film to uniaxial or biaxial elongation by an drawing device to thereby form minute cavities depending upon the core particles of the non-compatible substance not only at the surface but also in the inside of the film.

The polyester resin includes polycondensed resins of aromatic dicarboxylic acids (e.g. terephthalic acid, isophthalic acid and naphthalene dicarboxylic acid) and diols (e.g. ethylene glycol, diethylene glycol, 1.4butanediol, neopentyl glycol and 1,4-cyclohexanedimethanol).

The non-compatible substance includes inorganic pigments such as calcium carbonate, silica, titanium oxide, alumina, and aluminum sulfate; and organic substances such as high density polyethylene and crystalline polypropylene.

The amount of the non-compatible substance to be added in the preparation of the adiabatic foamed polyester resin film should be properly determined depending upon the kind of the polyester resin to be used, the kind of the non-compatible substance to be used and the apparent specific gravity to be provided for the resulting adiabatic foamed polyester resin film. However, in general, it is 3 to 40% by weight versus the amount of the polyester resin to be used.

In a typical embodiment of preparing an adiabatic foamed polyester resin film containing minute cavities with an apparent specific gravity in the range of 0.9 to 1.2 to be the substrate of the heat-sensitive recording material, a predetermined amount of the foregoing polyester resin and a predetermined amount of the foregoing non-compatible substance are melt-blended at a temperature of 250° to 300° C. to obtain a mixture, and the mixture is extruded by a fusion extruder, followed by cooling to less than 70° C., to thereby obtain a substantially non-oriented film. The film thus obtained is then subjected to lengthwise elongation by a draw roller or/and to crosswise elongation by a tentering machine to thereby obtain the foregoing adiabatic foamed polyester resin film. The magnification in either the lengthwise elongation or the crosswise elongation is controlled to be in the range of 2 to 5. The apparent specific gravity with respect to the minute cavities of the resulting adiabatic foamed polyester resin film may be properly adjusted to a predetermined value by selectively using the non-compatible substance and controlling the amount of said substance to be added, the temperature at the time of elongation and the elongation magnification as required.

There is a tendency that the content of minute cavities of the resulting adiabatic foamed polyester resin film will be increased and the apparent specific gravity with respect to the minute cavities will become small as the amount of the non-compatible substance to be added is increased, the elongation magnification is heightened, and the temperature at the time of elongation is lowered.

Likewise, the adiabatic foamed polyester resin film obtained as a result of the elongation treatment may be subjected to heat treatment. In this case, the dimensional stability of the film is improved. Further, the substrate of the heat-sensitive recording material of the present invention which comprises the foregoing adiabatic foamed polyester resin film may have a coated layer containing an antistatic agent.

As for the thickness of the substrate of the heat-sensitive recording material according to the present invention, there is not a particular restriction therefor and it is properly determined depending upon the kind of the heat-sensitive recording material to be obtained. However, in general, it is preferably in the range of 30 to 200 μm, more preferably in the range of 40 to 150 μm, or most preferably in the range of 40 to 80 μm.

A most desirable adiabatic foamed polyester resin film containing minute cavities with an apparent specific gravity in the range of 0.9 to 1.2 which excels in heat resistance and mechanical strength and which is most preferred to be used as the substrate of the heat-sensitive recording material of the present invention can be obtained when biaxial elongation is practiced.

The adiabatic foamed polyester film to be used as the substrate of the heat-sensitive recording material according to the present invention may contain a pigment such as titanium oxide, a stabilizer, an antistatic agent, a dye, etc. in amounts harmless to the effect of the film. In this case, the whiteness, covering power and the like of the film are improved. The incorporation of these adjuvants into the film is carried out by adding them into the mixture of the starting substances in the preparation of the film.

As above described, the heat-sensitive recording material according to the present invention is characterized by having the substrate comprising the foregoing specific adiabatic foamed polyester resin film containing minute cavities with an apparent specific gravity in the range of 0.9 to 1.2 and because of this, it brings about various advantages as above described.

The present inventors have confirmed the following facts through experiments. That is, when a foamed polyester resin film containing minute cavities with an apparent specific gravity exceeding 1.2 is used as the substrate, the resulting heat-sensitive recording material becomes such that is not satisfactory in the adiabatic property and cushioning property, does not exhibit a sufficient recording sensitivity and hardly provides such desirable images excelling in both gradation and resolution. Likewise, when a foamed polyester resin film containing minute cavities with an apparent specific gravity of less than 0.9 is used as the substrate, the resulting heat-sensitive recording material becomes such that is apt to cause local extension and/or curling by heat upon contact with the recording head.

In a typical embodiment of the heat-sensitive recording material according to the present invention, a heat-sensitive recording layer is disposed on the substrate comprising the foregoing specific adiabatic foamed polyester resin film. In an alternative, it is possible to dispose an intermediate layer such as an anchor coat layer or an adhesive layer between the substrate and the heat-sensitive recording layer in order to ensure the adhesion of the substrate with the recording layer. Further, in order for the toughness of the substrate to be improved, it is possible to dispose a core layer on the rear side of the substrate.

The heat-sensitive recording layer of the heat-sensitive recording material according to the present invention may be formed by applying a coating dispersion containing a color former and a color developer onto the surface of the foregoing adiabatic foamed polyester resin film as the substrate to form a liquid layer on said surface and air-drying said liquid layer.

As the color former, any of known color formers can be used as long as desirable color development is caused when it is contacted with the developer used by heating. As the color developer, any of known color developers can be used as long as the above requirement is fulfilled.

As the combination of the color former and the color developer, there can be used a combination of a colorless or light-colored basic dye and an organic or inorganic acid substance which produce color upon contact with said basic dye; a combination of a metal salt of a higher fatty acid such as ferric stearate and a phenolic acid such as gallic acid; a combination of a diazonium compound, a coupler and a basic substance, and the like.

Usable as the colorless or light-colored basic dye are, for example, triarylmethane dyes such as 3,3-bis(p-dimethyl-aminophenyl)-6-dimethylaminophthalide, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3,3-bis(1,2-dimethylindol-3-yl)-5-dimethylaminophthalide, 3,3-bis(1,2-diemthylindol-3-yl)-6-diemthylaminophthalide, 3,3-bis(9-ethylcarbazol-3-yl)-6-dimethylaminophthalide, 3,3-bis(2-phenylindol-3-yl)-6-dimethylaminophthalide, and 3-p-dimethylaminophenyl-3-(1-methylpyrrol-3-yl)-6-dimethylaminophthalide; diphenylmethane dyes such as 4,4'-bis-dimethylaminobenz-hydrylbenzylethyer, N-halophenylleucoauramine, N-2,4,5-trichlorophenyl-leucoauramine; thiazine dyes such as benzoyl-leucomethyleneblue and p-nitrobenzoyl-leucomethyleneblue; spiro dyes such as 3-methyl-spiro-dinaphthopyran, 3-ethyl-spiro-dinaphthopyran, 3-phenyl-spiro-dinaphthopyran, 3-benzyl-spirodinaphthopyran, 3-methyl-naphtho-(6'-methoxybenzo)spiropyran, and 3-propyl-spiro-dibenzopyran; lactam dyes such as rhodamine-B anilino-lactam, rhodamine (p-nitroanilino)lactam, and rhodamine-(o-chloroanilino) lactam; and fluoran dyes such as 3-dimethyl-amino-7-methoxyfluoran, 3-diethylamino-6-methoxyfluoran, 3-diethylamino-7methoxyfluoran, 3-diethylamino-7-chlorofluoran, 3-diethylamino-6-methyl-7-chlorofluoran, 3-diethylamino-6, 7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7dibenzylaminofluoran, 3-diethylamino-7-N-methyl-N-benzylaminofluoran, 3-diethylamino-7-N-chloroethyl-Nmethylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(ptoluidino)fluoran, 3-diethylamino-6-methyl-7-phenylaminofluoran, 3-dibutylamino-6-methyl-7-phenylaminofluoran, 3-diethylamino-7-(2-carbomethoxy-phenylamino)fluoran, 3-(N-cyclohexyl-N-methylamino)-6-methyl-7-phenylaminofluoran, 3- pyrrolidino-6-methyl-7-phenylaminofluoran, 3-pyperidino-6-methyl-7-phenylaminofluoran, 3-diethylamino-t-methyl-7xylidinofluoran, 3-diethylamino-7-(o-chlorophenylamino)fluoran, 3-dibutylamino-7-(o-chlorophenylamino) fluorn, 3-pyrrolidino-6-methyl-7-p-butylphenyl-aminofluoran, 3-(N-methyl-N-n-amyl)amino-6-methyl-7-phenylaminofluoran, 3-(N-ethyl-N-n-amyl-)amino-6-methyl-7-phenylaminofluoran, 3-(N-ethyl-N-iso-amyl)amino-6-methyl-7phenylaminofluoran, 3-(N-methyl-N-n-hexyl)amino-6-methyl-7-phenylaminofluoran, 3-(N-ethyl-N-n-hexyl)amino-6-methyl-7phenylaminofluoran, 3-(N-ethyl-N-8-ethylhexyl-)amino-6-methyl-7-phenylaminofluoran, 3-(N-ethyl-N-tetrahydrofur-furyl)amino-6-methyl-7-phenylaminofluoran, and 3-(N-ethyl-N-cyclopentyl)amino-6-methyl-7-phenylaminofluoran. These basic dyes may be used alone or in combination of two or more of them.

Usable as the organic acid substance as the developer which produces a color upon contact with any of the above-mentioned basic dye are those substances as mentioned below.

That is, phenolic compounds such as 4-tert-butylphenol, e-naphthol, α-naphthol, β-acetylphenol, 4-tert-octylphenol, 4,4'-sec-butylidenediphenol, 4-phenylphenol, 4,4'-dihydroxydiphenylmethane, hydroquinone, 4,4'-isopropylidenediphenol, 4,4'-cyclohexylidenediphenol, 4,4'-(1,3-dimethylbutylidene)bisphenol, 4,4'-dihydroxydiphenylsulfide, 4,4'-thiobis(6-tert-butyl-3-methylphenol), 4,4'-dihydroxydiphenylsulfone, 4-hydroxy-4'-methyldiphenylsulfone, 4-hydroxy-4'-methoxydiphenylsulfone, 4-hydroxy-4'isopropoxydiphenylsulfone, 4-hydroxy-3',4'-trimethylenediphenylsulfone, 4-hydroxy-3', 4'-tetramethylenediphenylsulfone, 3,4-dihydroxy-4'-methyldiphenylsulfone, bis(3-allyl-4-hydroxyphenyl)sulfone, 1,3-di2--(4-hydroxyphenyl)-2-propyl-benzene, hydroquinonebenzl ether, bis(4-hydroxyphenyl)acetic acid butyl ester, 4-hydroxybenzophenone, 2,4-dihydroxybenzophenone, 2,4,4'-trihydroxybenzophenone, 2,2',4,4'-tetrahydrobenzophenone, dimethyl 4-hydroxyphthalate, methyl 4-hydroxybenzoate, 4-hydroxybenzoic acid ester, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4hydroxybenzoate, chlorophenyl 4-hydroxybenzoate, phenylpropyl 4-hydroxybenzoate, phenetyl 4-hydroxybenzoate, p-chlorobenzyl 4-hydroxybenzoate, p-methoxybenzl 4-hydroxybenzoate novolak-type phenolic resin, and phenol polymer; aromatic carboxylic acids such as benzoic acid, p-tert-butyl benzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3,5-di-tert-butylsalicylic acid, 3-benzylsalicylic acid, 3-(α-methylbenzl)salicylic acid, 3-chloro-5-(o-methylbenzl-)salicylic acid, 3-phenyl-5(α-edimethylbenzyl)salicylic acid, and 3,5-di-α-methylbenzylsalicylic acid; and salts of phenolic compounds or aromatic carboxylic acids with a polyvalent metal such as zinc, magnesium, aluminum, calcium, titanium, manganese, tin, and nickel.

These substances usable as the color developer may be used alone or in combination of two or more of them.

The basic dye and color developer are used in a proper ratio which is not specifically limited but is determined property depending upon the kinds of them to be selectively used.

In general, 100 parts by weight of the basic dye are used for 100 to 700 parts by weight, preferably 150 to 400 parts by weight of the color developer.

The coating dispersion containing the foregoing basic dye and the foregoing color developer is prepared by dispersing them into water individually or altogether using a mixer or grinder such as ball mill, attritor, and sand mill.

It is desired for the coating dispersion to contain a binder in an amount of 2 to 40 wt%, preferably 5 to 25 wt%, of the total amount of solids.

Usable as the binder are, for example, starch, hydroxyethyl cellulose, methyl cellulose, carboxymethyl cellulose, gelatin, casein, gum arabic, polyvinyl alcohol, diisobutylene-maleic anhydride copolymer salt, styrenemaleic anhydride copolymer salt, ethylene-acrylic acid copolymer salt, styrene-acrylic acid copolymer salt, styrene-butadiene copolymer emulsion, urea resin, melamine resin, and amide resin.

The coating dispersion may contain a variety of auxiliaries such as dispersing agent, antifoaming agent, fluorescent dye, and coloring dye. Usable as the dispersing agent are, for example, sodium dioctylsulfosuccinate, sodium dodecylbenzenesulfonate, lauryl alcohol sulfate ester sodium salt, and metal salt of fatty acid.

The coating dispersion may further contain an inorganic pigment such as kaolin, clay, talc, calcium carbonate (including prismatic one), calciuned clay, titanium oxide, diatomaceous earth, anhydrous silica fine powder, and activated clay. In this case the resulting heat-sensitive recording material becomes such that does not generate foreign matters causing contamination of the recording head of the printing system.

For the coating dispersion from which the heat-sensitive recording layer of the heat-sensitive recording material is to be formed, it is possible to contain a dispersion or emulsion of one or more members selected from the group consisting of stearic acid, polyethylene, carnauba wax, paraffin wax, ester wax, zinc stearate and calcium stearate. In this case, the resulting heat-sensitive recording material becomes such that does not cause sticking upon contact with the recording head.

Further, in case where necessary, the coating dispersion may contain a relevant ultraviolet ray absorber or/and a relevant sensitizer. Usable as such sensitizer are, for example, fatty acid amides such as stearic acid amide, stearic acid methylene bisamide, oleic acid amide, palmitic acid amide, and coconut fatty acid amide; hindered phenols such as 2,2'-methylenebis(4-methyl-6-tert-butylphenal, 4,4'-butylidenebis(6-tert-butyl-3-methylphenol), and 1,1,3-tris(2-methyl-4-hydroxy-5-tert-butylphenyl)butane; ethers such as 1,2-bis(phenoxy)ethane, 1,2-bis(4-methylphenoxy)ethane, 1,2-bis(3-methylphenoxy)ethane, 1-phenoxy-2-(4-methylphenoxy)ethane, 2-naphtholbenzyl ether, 1,4-dimethoxynaphthalene, and 1,4-diethoxynaphthalene; esters such as dibutyl terephthalate, dibenzyl terephthalate, and 2-phenyl 1-hydroxynaphthoate; other than these, p-benzyl-biphenyl.

Usable as such ultraviolet absorber are, for example, 2-(2'-hydroxy-5'-methylphenyl)benzotriazole, and 2-hydroxy4-benzyloxybenzophenone.

The recording layer of the heat-sensitive recording material according to the present invention is formed by applying the foregoing coating dispersion onto the surface of the foregoing specific substrate in a predetermined amount to form a liquid coat and air-drying the liquid coat.

The application of the coating dispersion onto the surface of the substrate may be carried out by means of a conventional coating equipment such as air knife coater, blade coater, bar coater, gravure coater, curtain coater, etc.

The amount of the coating dispersion to be applied onto the surface of the substrate is not specifically limited; but it is usually 2 to 12 g/m$^2$, preferably 3 to 10 g/m$^2$ on the basis of dry weight.

The heat-sensitive recording material of the present invention may be provided, if necessary, with additional layers which are known in the field to which the present invention pertains. For example, an overcoat layer (protective layer) may be disposed on the heat-sensitive recording layer for the purpose of protection. Such protective layer may be disposed also on the rear side of the substrate. Further, it is possible to dispose an intermediate layer (undercoat layer) between the substrate and the heat-sensitive recording layer.

Further in addition, an adhesive layer may be disposed on the rear side of the heat-sensitive recording material so that it can be fabricated into self-adhesive stickers.

Incidentally, the protective layer is usually composed of a pigment such as kaolin and talc; a binder such as starch and polyvinyl alcohols including modified polyvinyl alcohol; an optional lubricant such as zinc stearate; and an optional ultraviolet ray absorber. The intermediate layer is usually composed of a pigment such as calcined clay and anhydrous silica fine powder; a binder such as styrene-butadiene copolymer emulsion, polyvinyl alcohol, and starch; an optional sensitizer; and an optional color developer.

DESCRIPTION OF THE PREFERRED EMBODIMENTS

The present invention will be described in more detail with reference to the following examples, which are not intended to restrict the scope of the invention. In examples, "parts" and "%" mean "parts by weight" and "wt%", respectively, unless otherwise defined.

Preparation of White Foamed Polyester Resin Films

There was prepared a 60 um thick white foamed polyester resin film containing minute cavities with an apparent specific gravity of 1.0 by blending polyethyleneterephthalate pellets and crystalline polypropylene pellets in an amount of 10 wt% versus the amount of said polyethyleneterephthalate pellets to obtain a mixture, melt-extruding the mixture at 290° C. by a fusion extruder, followed by cooling on a cooling drum maintained at 40° C. to obtain a non-oriented film, subjecting the resultant film to lengthwise elongation with an elongation magnification of 3.0 by a draw roller, then subjecting the resultant film to crosswise elongation with an elongation magnification of 3.3 by a tentering machine. This situation was shown in Table 1. The white foamed polyester resin film thus obtained was made Film Sample No. 1 as shown in Table 1.

The above procedures were repeated, except that the amount of the crystalline polypropylene pellets to be used was changed as shown in Table 1, to thereby obtain four other different white foamed polyester resin films respectively of 60 μm in thickness and containing minute cavities with a different apparent specific gravity (Film Samples Nos. 2–5) as shown in Table 1.

The apparent specific gravity (g/cm$^3$) of each of the resultant film samples was obtained by cutting off a film sample of 10 cm by 10 cm in size from the resultant film sample, measuring the weight and the average thickness of the cut-off film sample, and calculating the weight per unit volume (g/cm$^3$).

TABLE 1

| Film Sample No. | The amount of crystalline polypropylene pellets used (wt %) | Apparent specific gravity (g/cm$^3$) |
|---|---|---|
| 1 | 10 | 1.0 |
| 2 | 12 | 0.93 |
| 3 | 6 | 1.15 |
| 4 | 17 | 0.80 |
| 5 | 3 | 1.30 |

EXAMPLE 1

(1) Preparation of dispersion A

A composition composed the following components was ground using a sand mill until the average particle size reached 2 μm. Thus there was obtained a dispersion as the dispersion A.

| | |
|---|---|
| 3-(N-ethyl-N-isoamyl)amino-6-methyl-7-phenylaminofluoran | 10 parts |
| 1,2-bis(3-methylphenoxy)ethane | 20 parts |
| methylcellulose (5% aqueous solution) | 20 parts |
| Water | 40 parts |

(2) Preparation of dispersion B

A mixture composed of the following components was ground using a sand mill until the average particle size reached 2 μm. Thus there was obtained a dispersion as the dispersion B.

| | |
|---|---|
| 4,4'-isopropylidenediphenol | 30 parts |
| Methyl cellulose (5% aqueous solution) | 40 parts |
| Water | 20 parts |

(3) Preparation of coating dispersion

There was prepared a coating dispersion by well mixing parts of the foregoing dispersion A, 90 parts of the foregoing dispersion B, 30 parts of anhydrous silica fine powder name: MIZUKASIL P-527, product by MIZUSAWA Kabushiki Kaisha) and 250 parts of 10% polyvinyl alcohol aqueous solution while stirring.

The coating dispersion was applied onto the surface of a substrate comprising the white foamed polyester resin film of Film Sample No. 1 (apparent specific gravity: 1.0) shown in Table 1 in such an amount that the coating weight after drying was 5 g/m$^2$, and air-dried. The resultant coated sheet was subjected to supercalendering to thereby obtain a heat-sensitive recording material.

EXAMPLES 2–3 and Comparative Examples 1–2

There was prepared a heat-sensitive recording material by repeating the procedures of Example 1, except for using the white foamed polyester resin film of Film Sample No. 2 (apparent specific gravity: 0.93) shown in Table 1 is the substrate (Example 2).

Likewise, there was prepared a heat-sensitive recording material by repeating procedures of Example 1, except for using the white foamed polyester resin film of Film Sample No. 3 (apparent specific gravity: 1.15) shown in Table 1 as the substrate (Example 3).

(Comparative Examples 1–2)

There was prepared a comparative heat-sensitive recording material by repeating the procedures of Example 1, except for using the white foamed polyester resin film of Film Sample No. 4 (apparent specific gravity: 0.80) shown in Table 1 as the substrate (Comparative Example 1).

Likewise, there was prepared a comparative heat-sensitive recording material by repeating the procedures of Example 1, except for using the white foamed polyester resin film of Film Sample No. 5 (apparent specific gravity: 1.30) shown in Table 1 as the substrate (Comparative Example 2).

Comparative Example 3

The procedures of Example 1 were repeated, except that an opaque white polyester resin film containing titanium oxide of 1.45 in apparent specific gravity (trade name: DIAFOIL W-300, product by DIAFOIL Co., Ltd.) was used in stead of the white foamed polyester resin (Film Sample No. 1), to thereby obtain a comparative heat-sensitive recording material.

Comparative Example 4

The procedures of Example 1 were repeated, except that a foamed polypropylene resin film (trade name: YUPO-FPG, product by Ojiyukagohsei Kabushiki Kaisha, apparent specific gravity: 0.75) was used as the substrate, to thereby obtain a comparative heat-sensitive recording material.

EVALUATION

Each of the resultant seven heat-sensitive recording materials was evaluated with respect to various evaluation items required for a heat-sensitive recording material.

Evaluation of Recording Density

Each heat-sensitive recording material was passed through a UP-811 Type Videoprinter (product by Sony Corporation) to conduct recording of a known test chart of A-4 size at respective printing pulse conditions of 8 ms, 6 ms and 4 ms.

The density of each of the recorded images was measured using a Macbeth densitometer (RD 914, product by Macbeth Co., Ltd.). The results obtained were shown in Table 2.

Evaluation of Resolution

The recorded image obtained at 4 ms was evaluated with respect to resolution (reproduction of dots) under the following evaluation criteria A: the recorded image is not accompanied with any defect in reproduction of dots and excels in resolution.

B: the recorded image is accompanied with a slight defect in reproduction of dots, good in resolution, and practically acceptable.

C: the recorded image is accompanied with many defects in reproduction of dots, poor in resolution, and practically not acceptable.

The evaluated results were shown in Table 2.

Evaluation of Deformation

The situation of whether local extension was occurred or not on each of the foregoing seven heat-sensitive recording materials by heat upon recording by the foregoing videoprinter was observed by eyes under the following evaluation criteria:

A: any local extension is not observed

B: a slight local extension is observed, but the image-recorded product can be still considered as being of high grade.

C: apparent local extensions are observed at the portions of the heat-sensitive recording material on which images were recorded and the image-recorded product can not be considered as being of high grade.

D: significant local extensions are observed at the portion of the heat-sensitive recording material on which images were recorded and the image-recorded product is not practically acceptable.

The evaluated results obtained were shown in Table 2.

Observation of Shrinkage by Heat

A shrinkage ratio was measured for each of the foregoing seven heat-sensitive recording materials in accordance with JIS K-6734.

The measured results obtained were shown in Table 2. From the results shown in Table 2, it has been recognized that any of the heat-sensitive recording materials obtained in Examples 1 to 3 excels in recording sensitivity and in heat resistance and provides high quality images excelling in gradation and resolution.

TABLE 2

| | Example | | | Comparative Example | | | |
|---|---|---|---|---|---|---|---|
| | 1 | 2 | 3 | 1 | 2 | 3 | 4 |
| recording density | | | | | | | |
| 8 ms | 1.48 | 1.50 | 1.47 | 1.50 | 1.46 | 1.46 | 1.51 |
| 6 ms | 1.23 | 1.26 | 1.15 | 1.28 | 1.05 | 0.99 | 1.30 |
| 4 ms | 0.64 | 0.66 | 0.61 | 0.67 | 0.53 | 0.46 | 0.68 |
| resolution | A | A | B | A | C | C | A |
| occurrence of local extension | B | B | A | C | A | A | D |
| *heat shrinkage ratio (condition A) | | | | | | | |
| lengthwise direction | 0.9 | 1.1 | 0.7 | 1.2 | 0.6 | 0.5 | 4.1 |
| crosswise direction | −0.2 | −0.3 | −0.1 | −0.4 | 0 | 0 | 2.5 |
| (condition B) | | | | | | | |
| lengthwise direction | 1.7 | 2.0 | 1.4 | 2.2 | 1.3 | 1.2 | MELT |
| crosswise direction | 0.2 | 0.4 | 0.1 | 0.5 | 0.1 | 0.1 | |

Note:
conditions for the measurement of a heat shrinkage ratio:
condition A: heated at 140° C. for 5 minutes.
condition B: heated at 180° C. for 5 minutes.

What is claimed is:

1. An improved heat-sensitive recording material of the type having a substrate and a heat-sensitive recording layer formed on said substrate, said heat-sensitive recording layer containing a color former and a color developer to color said color former upon contact by heating, characterized in that said substrate comprises an adiabatic foamed polyester resin film containing minute cavities with an apparent specific gravity in the range of 0.9 to 1.2.

2. A heat-sensitive recording material according to claim 1, wherein said adiabatic foamed polyester resin film is a uniaxially or biaxially elongated adiabatic foamed polyester resin film containing minute cavities with an apparent specific gravity in the range of 0.9 to 1.2.

3. A heat-sensitive recording material according to claim 1, wherein said color former is a colorless or light-colored basic dye.

4. A heat-sensitive recording material according to claim 1, which further comprises an undercoat layer between the substrate and the heat-sensitive recording layer and/or a protective layer on said heat-sensitive recording layer.

* * * * *